US006118440A

United States Patent [19]

Tsunoda

[11] Patent Number: 6,118,440

[45] **Date of Patent: *Sep. 12, 2000**

[54] IMAGE DISPLAY SYSTEM AND DISPLAY CONTROL APPARATUS

[75] Inventor: Takashi Tsunoda, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/925,940

[22] Filed: Sep. 8, 1997

Related U.S. Application Data

[63] Continuation of application No. 08/354,022, Dec. 6, 1994, abandoned.

[30] Foreign Application Priority Data

Dec. 8, 1993 [JP] Japan ..... 5-307656

[51] Int. Cl.[7] ..... G09G 5/00

[52] U.S. Cl. ..... 345/213; 345/132; 345/97; 348/510; 348/540

[58] Field of Search ..... 345/1–3, 132, 345/213, 131, 128, 87, 99, 97; 348/510, 537, 540, 534, 544

[56] References Cited

U.S. PATENT DOCUMENTS

| | | | |
|---|---|---|---|
| 4,193,071 | 3/1980 | Hasegawa et al. | 345/128 |
| 4,275,421 | 6/1981 | Louie | 345/99 |
| 4,498,098 | 2/1985 | Stell | 348/510 |
| 4,574,279 | 3/1986 | Roberts | 340/731 |
| 4,751,502 | 6/1988 | Ishii et al. | 345/1 |
| 5,189,401 | 2/1993 | Kugler, Jr. et al. | 345/132 |
| 5,252,957 | 10/1993 | Itakura | 345/98 |
| 5,592,194 | 1/1997 | Nishikawa | 345/132 |
| 5,754,153 | 5/1998 | Miyutome et al. | 345/97 |

FOREIGN PATENT DOCUMENTS

| | | |
|---|---|---|
| 0456923 | 11/1991 | European Pat. Off. . |
| 2165128 | 4/1986 | United Kingdom . |
| WO9306587 | 4/1993 | WIPO . |

*Primary Examiner*—Lun-Yi Lao
*Attorney, Agent, or Firm*—Fitzpatrick, Cella, Harper & Scinto

[57] ABSTRACT

An image display system reproduces a dot clock on the basis of a horizontal sync signal that is generated from a host computer and displays an image on a display unit such as a ferroelectric liquid crystal display. In the host computer, a graphic card is provided with a transmitting unit for transmitting information necessary for display. The display unit comprises a receiver to receive the information necessary for the display and a change unit to change the display contents on the basis of the information received by the receiver. The information necessary for the display includes a sync signal frequency, a dot clock frequency, and an image information display period.

13 Claims, 4 Drawing Sheets

IMAGE DISPLAY SYSTEM AND DISPLAY CONTROL APPARATUS

This application is a continuation of application Ser. No. 08/354,022, filed Dec. 6, 1994 now abandoned.

BACKGROUND OF THE INVENTION

1. Field of the Invention

The invention relates to an image display system for displaying a dot clock signal on the basis of a horizontal sync signal and for displaying an image.

2. Related Background Art

FIG. 5 shows a conventional example of an image display system.

A host computer 1 is connected to a display unit 2 through a signal line 3. The host computer 1 transmits sync signals (horizontal sync signal, vertical sync signal) and an image signal to the display unit 2 through the signal line 3. A dot clock corresponding to the image signal is not transmitted from the host computer 1 through the signal line 3, the dot clock is reproduced in the display unit 2 on the basis of the horizontal sync signal. Generally, such a reproduction is performed by a PLL (Phase Locked Loop) circuit (not shown) in the display unit 2.

Now assuming that the host computer 1 corresponding to the display of (800×800) dots is switched to another host computer corresponding to the display of (1024×1024) dots, a frequency of the horizontal sync signal which is transmitted through the signal line 3 changes and, at the same time, the display dots and synchronizing frequency of the image signal which are transferred from such another host computer do not coincide with those of the display unit 2, so that the image display is not optimized.

Therefore, in order to inform the display unit 2 of the fact that the host computer (display information) was changed, the user sets a diagnosis software to such another host computer and sends a specific pattern to the display unit 2 through the signal line 3 for a predetermined time. The display unit 2 detects the specific pattern and stores the frequencies of the sync signals, dot clock, image display period, and the like and initializes a register and the like in the display unit 2 in order to match those parameters with those of such another host computer.

Such operations are also executed in case of exchanging a graphic card in the host computer.

As mentioned above, each time the host computer or graphic card is exchanged, the diagnosis has to be executed, so that it is very troublesome.

SUMMARY OF THE INVENTION

It is an object of the invention to solve the problems as mentioned above and to provide an image display system which can easily change the display contents.

To accomplish the above object, according to the invention, there is provided an image display system for reproducing a dot clock on the basis of a horizontal sync signal which is generated from a host computer and for displaying an image on a display unit, wherein a graphic card in the host computer has transmitting means for transmitting information necessary to display, and the display unit comprises receiving means for receiving the information necessary for the display and changing means for changing the display contents on the basis of the information received by the receiving means.

DETAILED DESCRIPTION OF THE PREFERRED EMBODIMENTS

An embodiment of the present invention will now be described in detail hereinbelow with reference to the drawings.

<First display unit>

Figure 1:
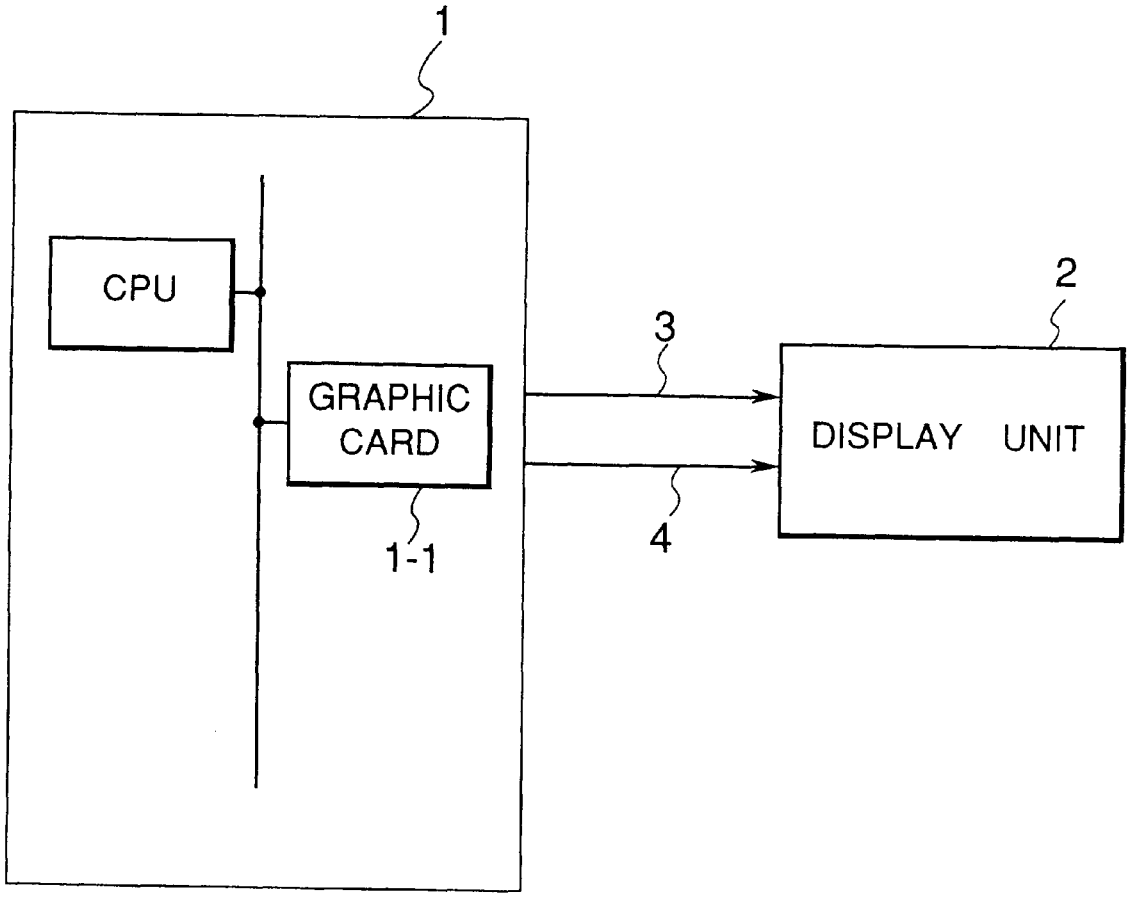
FIG. 1 is a block diagram showing a first unit of the invention.

FIG. 1 is a whole block diagram including a first display unit of the invention. In FIG. 1, reference numeral 1 denotes a host computer having a graphic card 1-1. The graphic card 1-1 has a circuit to transmit information necessary for display to the display unit. Since the host computer 1 has already been well known, its detailed description is omitted here. Reference numeral 2 denotes the display unit connected to the host computer 1 through signal lines 3 and 4. The host computer 1 transmits sync signals SYNC (horizontal, vertical) and an image signal IMAGE to the display unit 2 through the signal line 3. The host computer 1 transmits frequencies of the sync signals, a dot clock frequency, an effective image display period, and periods of a front porch, a back porch, and the like to the display unit 2 as information through the signal line 4.

Figure 2:
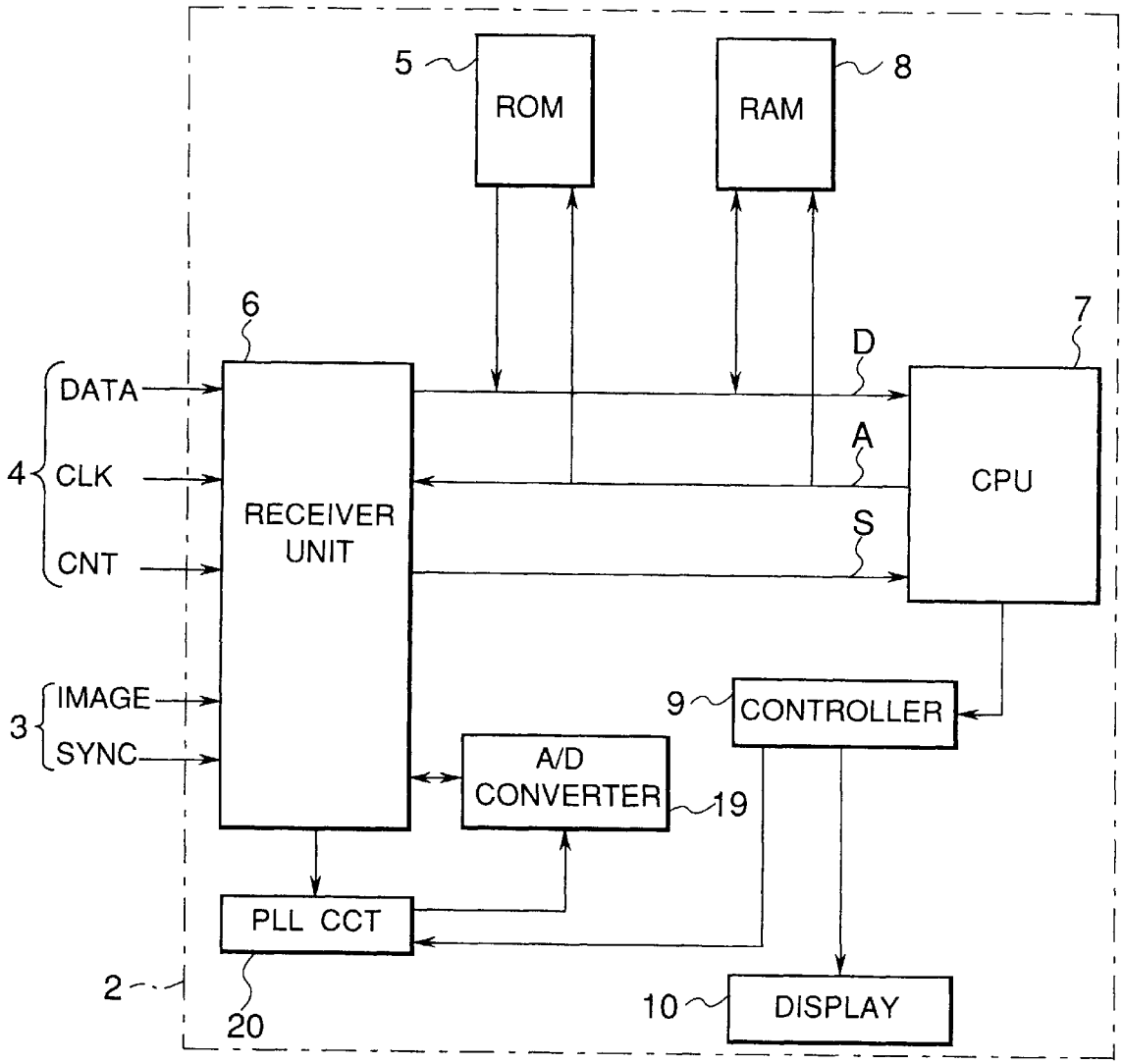
FIG. 2 is a block diagram showing a construction of a display unit 2 shown in FIG. 1.

FIG. 2 is a block diagram showing a construction of the display unit 2 shown in FIG. 1. In FIG. 2, the signal line 4 comprises three signal lines, namely, a signal line for a clock signal CLK, a signal line for a data signal DATA synchronized with the clock signal CLK, and a signal line for a control signal CNT. Reference numeral 5 denotes a ROM in which a control program has been stored; 6 a receiver unit to receive the information necessary for display; 7 a CPU for transmitting an address onto an address signal line (A) and for storing the data signal DATA into a RAM 8 when a logical change in control signal CNT is detected by the receiver unit 6; 9 a controller for changing the display contents on the basis of the data signal DATA stored in the RAM 8; and 10 a display.

Since the image display system is constructed as mentioned above, when the control signal CNT changes from logic "1" to logic "0", the receiver unit 6 detects such a change and notifies it to a CPU 7 through a signal line (S). When receiving such a signal, the CPU 7 transmits an address onto the address signal line (A) and stores the data signal DATA into the RAM 8 in accordance with the control program in the ROM 5.

The host computer 1 changes the control signal CNT from the logic "1" to the logic "0" for an arbitrary interval (for example, display blank period) and, after that, returns the control signal CNT from "0" to "1".

The data signal DATA stored in the RAM 8 is transferred to the controller 9 by the CPU 7. The controller 9 performs the initial setting of a PLL circuit 20 and the data transfer control for selecting one of a plurality of oscillators in order to generate the dot clock corresponding to the host computer and for displaying to the display 10. A liquid crystal display such as an FLCD (ferroelectric liquid crystal display) or the like is used as a display 10. An A/D converter 19 converts the analog image signal to the digital signal on the basis of the dot clock which is supplied from the PLL circuit 20. The A/D converted digital data is stored into the RAM 8 by the control of the CPU 7.

<Second display unit>

Figure 3:
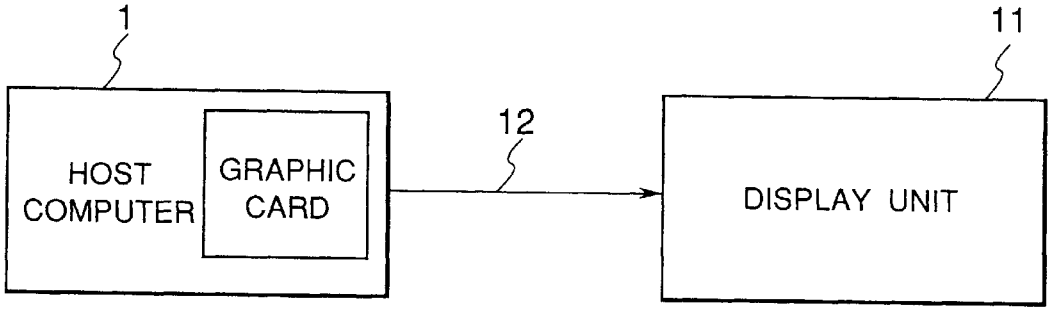
FIG. 3 is a block diagram showing a second display unit of the invention.

FIG. 3 is a whole block diagram including a second display unit of the invention. The host computer 1 and a display unit 11 are connected through a signal line 12. A composite signal including sync signals and an image signal is transmitted through the signal line 12.

According to the construction using the first display unit, the information necessary for display has been transmitted through the signal line (exclusive-use information signal line) 4. When comparing with the construction using the first display unit, however, the information necessary for display is transmitted as a composite signal through the signal line 12 for a blanking period of the vertical sync signal.

Figure 4:
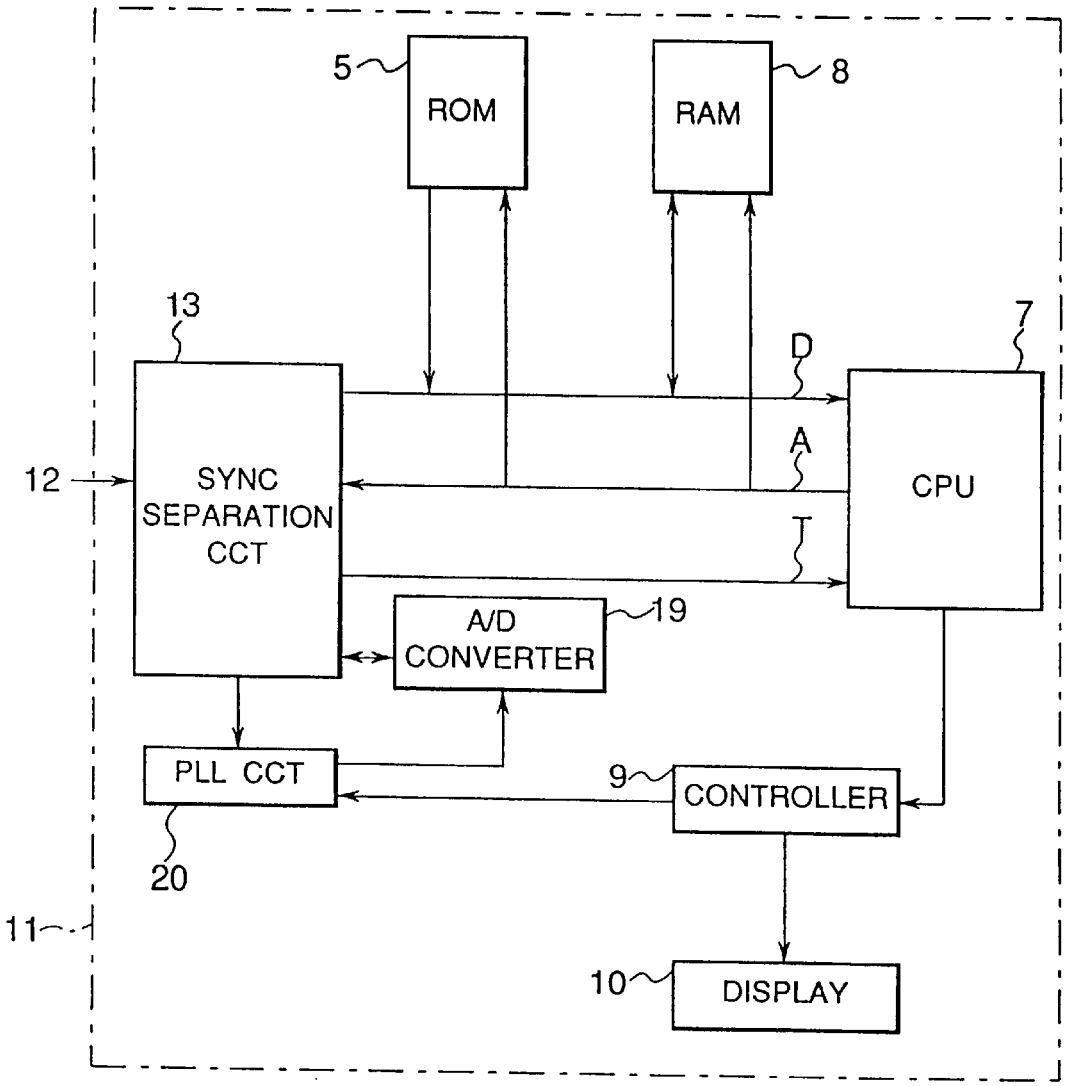
FIG. 4 is a block diagram showing a construction of a display unit 11 shown in FIG. 3.
Figure 5:
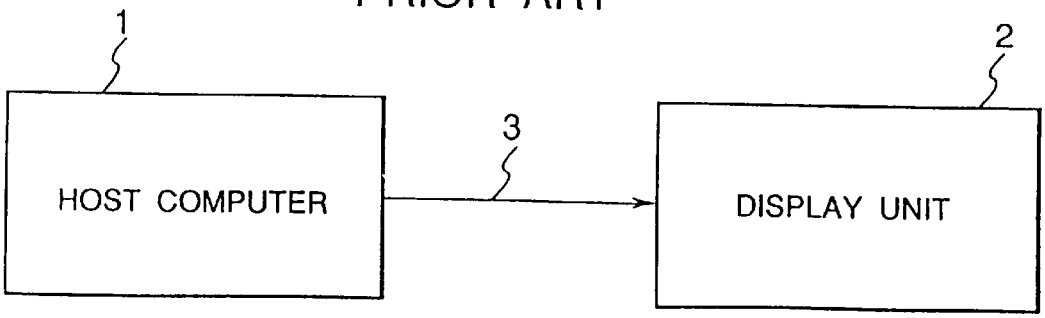
FIG. 5 PRIOR ART
FIG. 5 is a block diagram showing a conventional example of an image display system.

FIG. 4 shows a construction of the display unit 11 shown in FIG. 3. In FIG. 4, the component elements 5 and 7 to 10 are the same as those designated by the same reference numerals in FIG. 2. Reference numeral 13 denotes a sync separation circuit for separating the composite signal transmitted through the signal line 12 into the image signal and the sync signals and transmits the vertical sync signal onto a signal line (T).

With the above construction, when the CPU 7 detects a change in vertical sync signal on the signal line (T), for example, a change from the logic "1" to the logic "0", the CPU 7 generates an address onto the address line (A). The data signal DATA is stored into the RAM 8 in accordance with the control program in the ROM 5. The data stored in the RAM 8 is transferred to the controller 9 by the CPU 7. The controller 9 executes processes such as initial setting of the PLL circuit, selection of one of a plurality of oscillators in order to generate the dot clock corresponding to the host computer, and the like. At the same time, the controller 9 executes a data transfer control for displaying to the display 10.

<Graphic card>

The graphic card 1-1 shown in FIGS. 1 and 3 will now be described.

Figure 6:
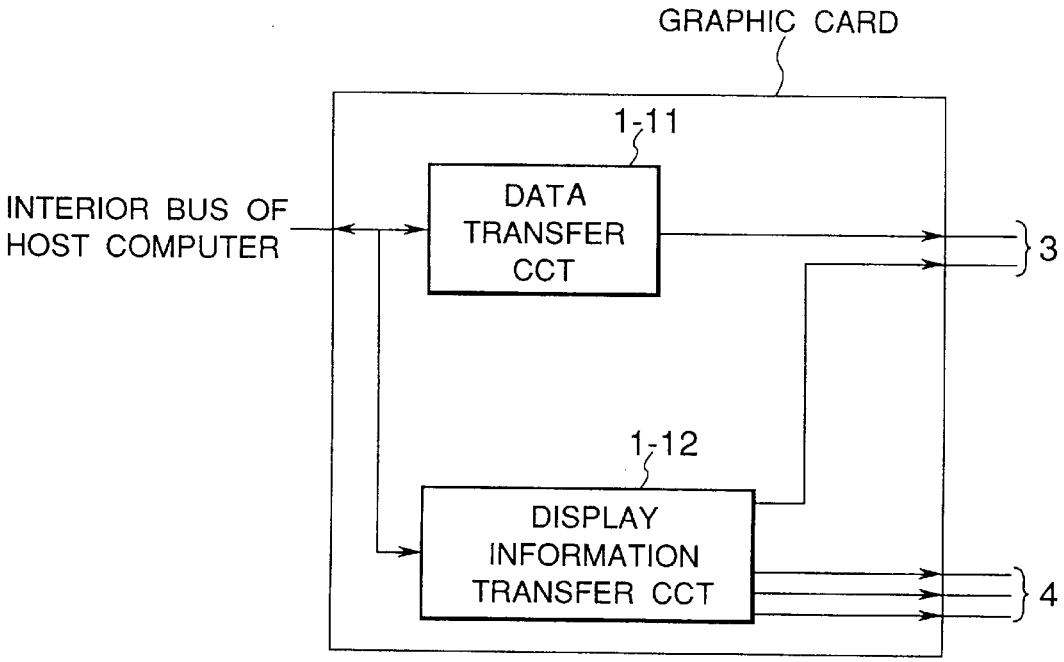
FIG. 6 is a block diagram showing a graphic card.

FIG. 6 is a block diagram showing the graphic card.

In the diagram, reference numeral 1-11 denotes a data transfer circuit. The digital display data which is supplied through a data bus in the host computer 1 is converted to the analog data. The analog data is transferred as an image signal to the display unit 2 by the data transfer circuit 1-11 through the signal line 3.

Reference numeral 1-12 denotes a display information transfer circuit for supplying the (horizontal, vertical) sync signals of the image signal to the display unit 2 through the signal line 3.

The display information transfer circuit 1-12 supplies each of the foregoing information necessary for the display unit 2 to perform the display control to the display unit 2.

In the graphic card 1-1 in FIG. 3, the signals are supplied as a composite signal to the display unit 11.

<PLL circuit>

Figure 7:
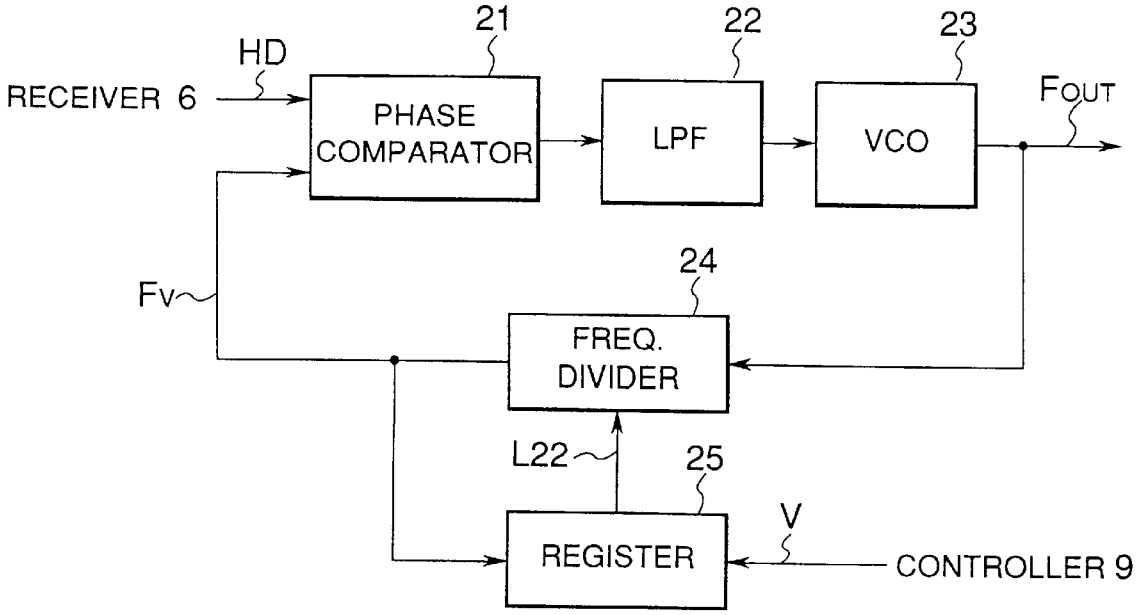
FIG. 7 is a block diagram showing a PLL circuit.

FIG. 7 is a block diagram of the PLL circuit 20.

First, a fundamental sync signal (horizontal sync signal HD) is supplied to one input terminal of a phase comparator 21. A signal $F_v$ is inputted to another input terminal of the phase comparator 21. The phase comparator 21 detects a phase difference between those two input signals and sends the detection information to a low pass filter (LPF) 22. The LPF 22 converts the output of the phase comparator 21 to the DC voltage necessary for a voltage controlled oscillator (VCO) 23. The VCO 23 generates a signal $F_{out}$ (dot clock) on the basis of the DC voltage. The signal $F_{out}$ generated from the VCO 23 is frequency divided by a frequency divider 24 on the basis of a value of a register 25 and is again fed back to the phase comparator 21 as a signal $F_v$. Thus, a desired multiplication frequency can be obtained from the reference signal (horizontal sync signal HD) by the VCO 23. A frequency division value of the register 25 is written by the controller 9 through a signal line (V). The frequency division value written in the register 25 is controlled on the basis of the signal $F_v$. When the signal $F_v$ is set to the logic "0", the frequency division value in the register 25 is again written into the frequency divider 24 through a signal line L22. The frequency divider 24 frequency divides the output signal $F_{out}$ of the VCO 23 by a predetermined frequency division value and, after that, the reference signal (horizontal sync signal HD) is compared with a phase frequency, thereby locking the phase.

Consequently, now assuming that the frequency division value is set to (N), the frequency of the output signal $F_{out}$ of the VCO 23 is locked to the frequency that is (N) times as high as the frequency of the reference signal (horizontal sync signal HD).

According to the invention as described above, the information necessary for display is transmitted by the graphic card in the host computer, the information necessary for display is received by the display unit, and the display contents are changed on the basis of the received information. Therefore, the display contents can be easily changed.

What is claimed is:

1. An image display system for generating a dot clock on the basis of a horizontal sync signal and for displaying an image, said system comprising:

a host computer having a graphic card comprising transmitting means for transmitting the horizontal sync signal, the image, and dot clock information including a dot clock frequency necessary for generation of the dot clock; and a display unit comprising:

receiving means for receiving the horizontal sync signal, the image and the dot clock information transmitted from said transmitting means;

generating means for generating a dot clock from the horizontal sync signal received by said receiving means;

initialization means for initializing said generating means in dependence upon the dot clock information received by said receiving means;

sampling means for sampling the image received by said receiving means on the basis of the dot clock generated by said generating means; and display means for displaying the image sampled by said sampling means.

2. A system according to claim 1, wherein the dot clock information includes a sync signal frequency, a dot clock frequency, and an image information display period.

3. An image display system according to claim 1, wherein said initialization means starts initializing in accordance with a signal from said host computer.

4. A display control apparatus for generating a dot clock on the basis of a horizontal sync signal and for displaying an image on a display unit, said apparatus comprising;

a graphic card for connecting the display control apparatus with a host computer;

receiving means for receiving a horizontal sync signal, image and dot clock information including a dot clock frequency necessary for generation of the dot clock through said graphic card from the host computer;

generating means for generating a dot clock from the horizontal sync signal received by said receiving means;

initialization means for initializing said generating means in dependence upon the dot clock information received by said receiving means;

sampling means for sampling image data received by said receiving means on the basis of the dot clock generated by said generating means initialized by said initialization means; and display control means for displaying the image sampled by said sampling means on the display unit.

5. An apparatus according to claim 4, wherein said display control means has a display screen comprising a ferroelectric liquid crystal.

6. An apparatus according to claim 4, wherein said initialization means performs an initial setting on the basis of a control signal supplied from a host computer.

7. An apparatus according to claim 6, wherein the control signal is made active during a display blank period.

8. A display control apparatus according to claim 4, wherein said initialization means starts initializing in accordance with a signal from the host computer.

9. A display control method of generating a dot clock on the basis of a horizontal sync signal and of displaying an image on a display unit, said method comprising the steps of:

receiving a horizontal sync signal, image and dot clock information including a dot clock frequency necessary for generation of the dot clock through a graphic card from a host computer, the graphic card connecting the display unit and the host computer;

generating a dot clock from the horizontal sync signal received in said receiving step;

initializing said generating step in dependence upon the dot clock information received in said receiving step;

sampling image data received in said receiving step on the basis of the dot clock generated in said generating step initialized in said initializing step; and displaying the image sampled in said sampling step on the display unit.

10. A method according to claim 9, wherein the display unit has a display screen comprising a ferroelectric liquid crystal.

11. A method according to claim 9, wherein said initializing step performs an initial setting on the basis of a control signal supplied from the host computer.

12. A method according to claim 11, wherein the control signal is made active during a display blank period.

13. An image display method according to claim 9, wherein said initializing step starts in accordance with a signal from the host computer.

* * * * *

UNITED STATES PATENT AND TRADEMARK OFFICE

CERTIFICATE OF CORRECTION

PATENT NO. : 6,118,440

DATED : September 12, 2000

INVENTOR(S): TAKASHI TSUNODA

It is certified that error appears in the above-identified patent and that said Letters Patent is hereby corrected as shown below:

ON THE TITLE PAGE

Item
[56] REFERENCES CITED:

U.S. PATENT DOCUMENTS, "5,754,153 5/1998 Miyutome et al."
should read --5,754,153 5/1998 Mizutome et al.--.

Signed and Sealed this

Eighth Day of May, 2001

*Attest:*

Nicholas P. Godici

NICHOLAS P. GODICI

*Attesting Officer*

*Acting Director of the United States Patent and Trademark Office*